US011412842B1

(12) United States Patent
Richards

(10) Patent No.: US 11,412,842 B1
(45) Date of Patent: Aug. 16, 2022

(54) DEPLOYABLE CHAIR AND DESK ASSEMBLY

(71) Applicant: Anthony Richards, Matawan, NJ (US)

(72) Inventor: Anthony Richards, Matawan, NJ (US)

( * ) Notice: Subject to any disclaimer, the term of this patent is extended or adjusted under 35 U.S.C. 154(b) by 0 days.

(21) Appl. No.: 17/323,286

(22) Filed: May 18, 2021

(51) Int. Cl.

| | |
|---|---|
| ***A47B 3/14*** | (2006.01) |
| ***A47C 7/66*** | (2006.01) |
| ***A47B 37/04*** | (2006.01) |
| ***A47B 21/06*** | (2006.01) |
| ***A47C 3/20*** | (2006.01) |
| ***A47B 39/02*** | (2006.01) |
| ***A47B 39/06*** | (2006.01) |
| ***A47B 39/12*** | (2006.01) |
| ***A47B 21/02*** | (2006.01) |

(52) U.S. Cl.

CPC ..... *A47B 3/14* (2013.01); *A47B 21/02* (2013.01); *A47B 21/06* (2013.01); *A47B 37/04* (2013.01); *A47B 39/023* (2017.08); *A47B 39/06* (2013.01); *A47B 39/12* (2013.01); *A47C 3/20* (2013.01); *A47C 7/66* (2013.01); *A47B 2003/145* (2013.01); *A47B 2021/066* (2013.01)

(58) Field of Classification Search

CPC ..... A47B 3/14; A47B 2003/145; A47B 2021/066; A47C 7/66; A47C 7/664

USPC ..... 297/184.1, 184.11, 184.12, 184.13, 297/184.15, 184.16, 184.17

See application file for complete search history.

(56) References Cited

U.S. PATENT DOCUMENTS

| | | | | |
|---|---|---|---|---|
| 1,264,609 | A | 4/1918 | Burnes | |
| 1,423,661 | A | 7/1922 | Henderson | |
| 1,979,173 | A | 10/1934 | Quatraro | |
| 5,350,215 | A * | 9/1994 | DeMars | A47C 7/624 297/188.14 |
| 6,371,553 | B1 * | 4/2002 | Tang | A47C 4/286 297/184.11 |
| 7,134,719 | B2 * | 11/2006 | Moglin | A47C 7/72 297/188.21 |
| 7,243,990 | B1 * | 7/2007 | Wahl | A47C 7/66 297/184.15 |
| 8,231,172 | B2 | 7/2012 | Quinn | |
| 8,497,656 | B2 | 7/2013 | Portis | |
| 8,794,699 | B1 * | 8/2014 | Rudolfo | A47C 4/20 297/118 |
| 9,254,037 | B2 | 2/2016 | Benden | |
| 9,578,972 | B2 * | 2/2017 | Purintun | A47C 7/723 |

(Continued)

FOREIGN PATENT DOCUMENTS

| | | | |
|---|---|---|---|
| WO | WO2010093870 | 8/2010 | |
| WO | WO-2021026226 A1 * | 2/2021 | A47C 1/143 |

*Primary Examiner* — Jose V Chen

(57) ABSTRACT

A deployable chair and desk assembly allowing for facile repositioning to different locations includes a chair and a desk. A pair of posts is engaged to and extends upwardly from a back of the chair. A canopy engaged to the posts shades the chair. A beam is engaged to and extends between the back of the chair and the desk so that the desk is positioned proximate to a front edge of the chair and provides a work surface for a user seated in the chair. Each of a set of ports is engaged to one of the chair and the desk and can operationally engage an electronic device. A solar panel is engaged to an upper surface of the canopy and is operationally engaged to the ports. The solar panel converts light into an electrical current to power an electronic device engaged to a respective port.

14 Claims, 5 Drawing Sheets

(56) References Cited

U.S. PATENT DOCUMENTS

| | | | | |
|---|---|---|---|---|
| 9,808,087 | B1 * | 11/2017 | Ghazal | A47C 1/14 |
| D876,805 | S | 3/2020 | Akin | |
| 2009/0058354 | A1 | 3/2009 | Harrison | |
| 2014/0097652 | A1 * | 4/2014 | Minkoff | A47C 7/744<br>297/180.14 |
| 2014/0132041 | A1 * | 5/2014 | Manus | A47C 7/546<br>297/184.17 |
| 2014/0252817 | A1 * | 9/2014 | Lovley, II | A47C 7/66<br>297/184.15 |
| 2016/0353727 | A1 * | 12/2016 | Ruybal | A47C 7/624 |
| 2017/0143126 | A1 * | 5/2017 | Wynn | A47C 7/66 |
| 2017/0265646 | A1 * | 9/2017 | Rowe, Jr. | E04H 15/46 |
| 2017/0321426 | A1 * | 11/2017 | Greer | E04H 15/58 |
| 2018/0110335 | A1 * | 4/2018 | O'Hagan | A47C 1/11 |
| 2020/0221876 | A1 * | 7/2020 | Morales | A47C 7/66 |
| 2020/0329878 | A1 * | 10/2020 | Bastiyali | A47C 7/727 |
| 2021/0321781 | A1 * | 10/2021 | Silinski | A47C 7/624 |
| 2021/0353048 | A1 * | 11/2021 | Rivera, Jr. | A47B 3/14 |

* cited by examiner

DEPLOYABLE CHAIR AND DESK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to desk assemblies and more particularly pertains to a new desk assembly allowing for facile repositioning to different locations. The present invention discloses a desk assembly comprising a desk, chair, and a canopy, and more particularly a desk assembly that is foldable.

(2) Description of Related Art Including Information Disclosed Under 37 CFR 1.97 and 1.98

The prior art relates to desk assemblies. Prior art desk assemblies may comprise school desks, canopied lawn chairs, picnic tables equipped with umbrellas having solar panels. What is lacking in the prior art is a desk assembly comprising a desk, chair, and a canopy, and more particularly a desk assembly that is foldable.

BRIEF SUMMARY OF THE INVENTION

An embodiment of the disclosure meets the needs presented above by generally comprising a chair and a desk. A pair of posts is engaged to a back of the chair and extends upwardly from the back. A canopy, which is engaged to and extends from the posts distal from the back of the chair, is configured to shade the chair. A beam is engaged to the back of the chair and extends from the back to proximate to a front edge of the chair. The desk is engaged to the beam distal from the back of the chair and provides a work surface for a user seated in the chair. Each of a set of ports is engaged to one of the chair and the desk and is configured to operationally engage an electronic device. A solar panel is engaged to an upper surface of the canopy and is operationally engaged to the set of ports. The solar panel is configured to convert light into an electrical current to power an electronic device that is operationally engaged to a respective port.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
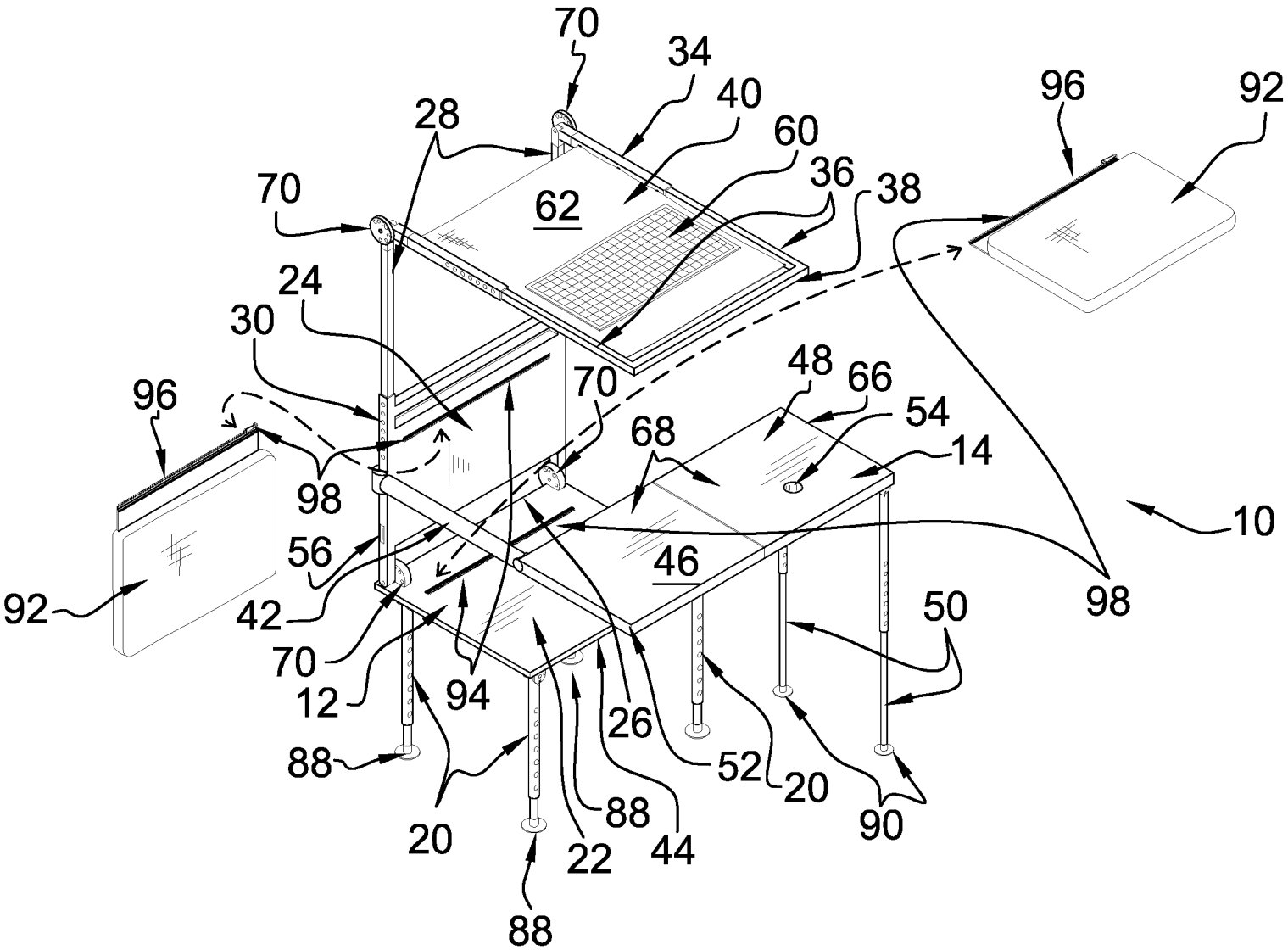
FIG. 1 is an isometric perspective view of a deployable chair and desk assembly according to an embodiment of the disclosure.

With reference now to the drawings, and in particular to FIGS. 1 through 5 thereof, a new desk assembly embodying the principles and concepts of an embodiment of the disclosure and generally designated by the reference numeral 10 will be described.

As best illustrated in FIGS. 1 through 5, the deployable chair and desk assembly 10 generally comprises a chair 12 and a desk 14. The chair 12 comprises a first frame 16, a second frame 18, and a plurality of first legs 20, which is engaged to and which extends from the first frame 16. A first panel 22 and a second panel 24 are engaged to the first frame 16 the second frame 18, respectively. The second frame 18 is engaged to and extends from a rearward edge 26 of the first frame 16 so that the second frame 18 is opposingly positioned relative to the plurality of first legs 20. The second panel 24 is configured to support a back of a user who is seated upon the first panel 22. The first panel 22 and the second panel 24 may comprise rigid material, such as plastic, metal, wood, and the like, and be contoured to increase comfort. The first panel 22 and the second panel 24 may also comprise fabric.

A pair of posts 28 is engaged to a back 30 of the chair 12 and extends upwardly from the back 30. Each post 28 is selectively extensible from an associated one of opposed side elements 32 of the second frame 18. A canopy 34, which is engaged to and which extends from the posts 28 distal from the back 30 of the chair 12, is configured to shade the chair 12. The canopy 34 comprises a pair of side arms 36, a crosspiece 38, and a canvas 40. Each side arm 36 is engaged to and extends from a respective post 28. The crosspiece 38 is engaged to and extends between the side arms 36 distal from the posts 28. The canvas 40 is engaged to and extends between the side arms 36.

A beam 42 is engaged to the back 30 of the chair 12 and extends from the back 30 to proximate to a front edge 44 of the chair 12. The desk 14 is engaged to the beam 42 distal from the back 30 of the chair 12 and provides a work surface 46 for a user seated in the chair 12. The beam 42 may be selectively engageable to the back 30 of the chair 12 so that the desk 14 is selectively separable from the chair 12. The beam 42 is hingedly engaged to the desk 14 so that the beam 42 is foldable relative to the desk 14.

The desk 14 comprises a plate 48, which defines the work surface 46, and a plurality of second legs 50, which is engaged to and which extends from the plate 48. A first end 52 of the plate 48 is engaged to the beam 42. A hole 54 is positioned in the plate 48 is configured for selective insertion of a pole of an umbrella (not shown) to engage the umbrella to the desk 14.

Figure 4:
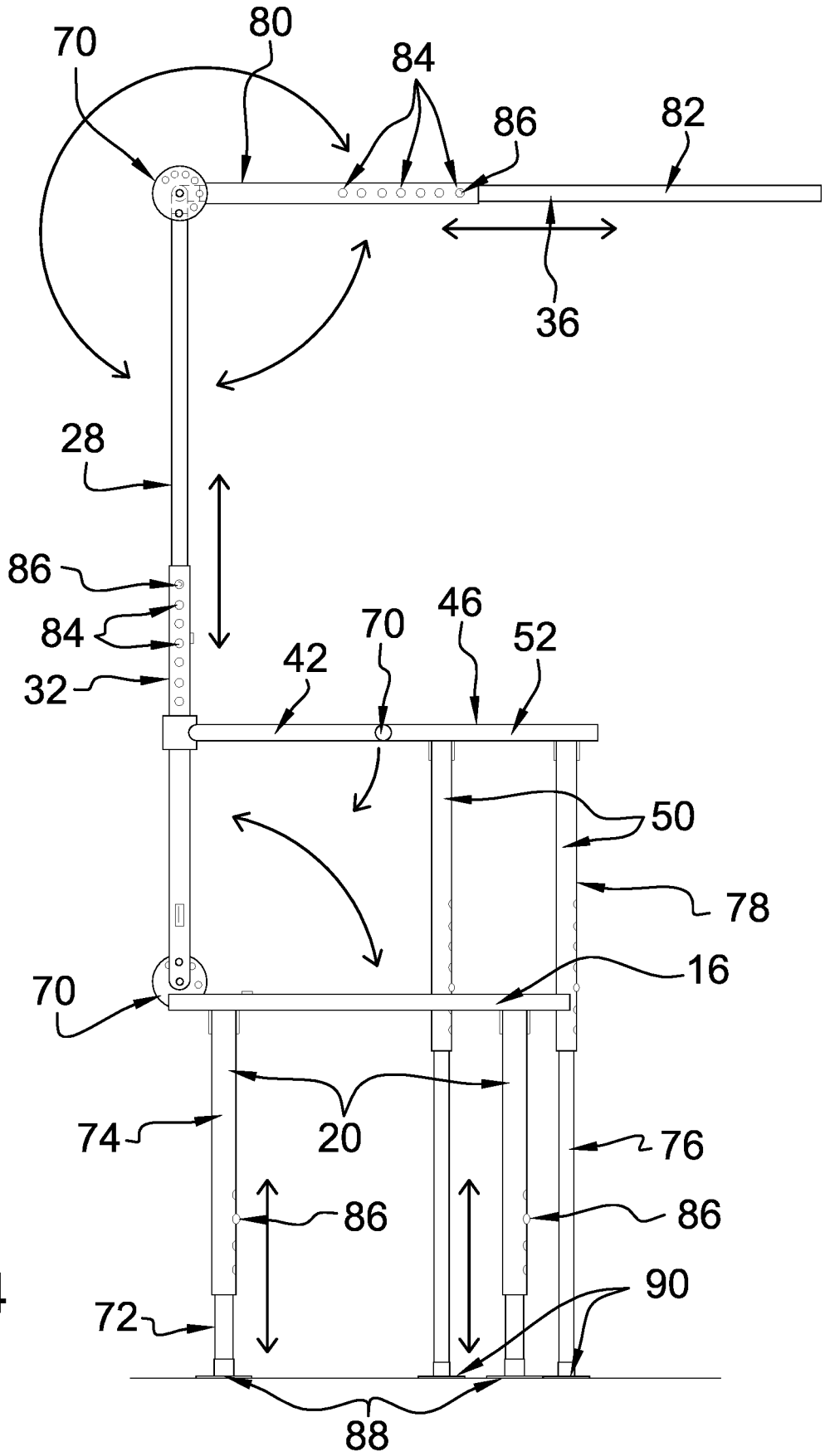
FIG. 4 is a side view of an embodiment of the disclosure.

Each of a set of ports 56 is engaged to one of the chair 12 and the desk 14 and is configured to operationally engage an electronic device (not shown). As shown in FIG. 4, the ports 56 may be engaged to a respective opposed side element 32 of the second frame 18. The set of ports 56 comprises Universal Serial Bus ports 58. A solar panel 60 is engaged to an upper surface 62 of the canopy 34 and is operationally engaged to the set of ports 56. The solar panel 60 is configured to convert light into an electrical current to power an electronic device that is operationally engaged to a respective port 56.

The present invention anticipates a battery (not shown) engaged to either the chair 12 or the desk 14 and being operationally engaged to the solar panel 60 and the ports 56. The present invention also anticipates a power inverter (not shown) operationally engaged to the battery and being configured to convert direct current from the battery to alternating current. The power inverter would allow devices requiring alternating current to be powered by the battery or the solar panel 60.

The first frame 16 may be substantially rectangularly shaped, as shown in FIG. 1, although the present invention also anticipates the first frame 16 being trapezoidally shaped or having an arcuate form. The plurality of first legs 20 comprises four first legs 20 positioned singly proximate to each corner 64 of the first frame 16. The plurality of second legs 50 comprises two second legs 50 extending from a second end 66 of the plate 48.

Figure 2:
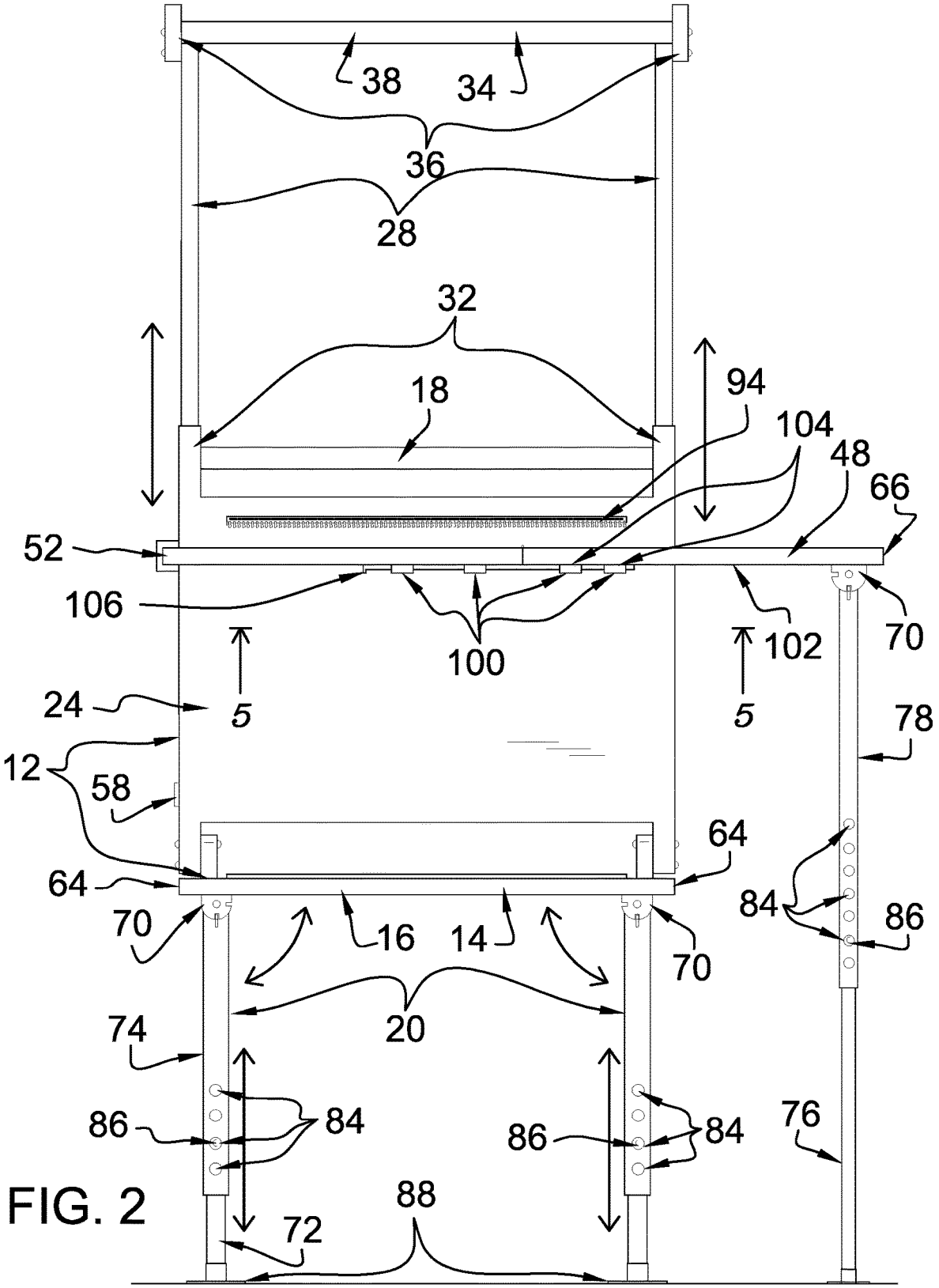
FIG. 2 is a front view of an embodiment of the disclosure.
Figure 3:
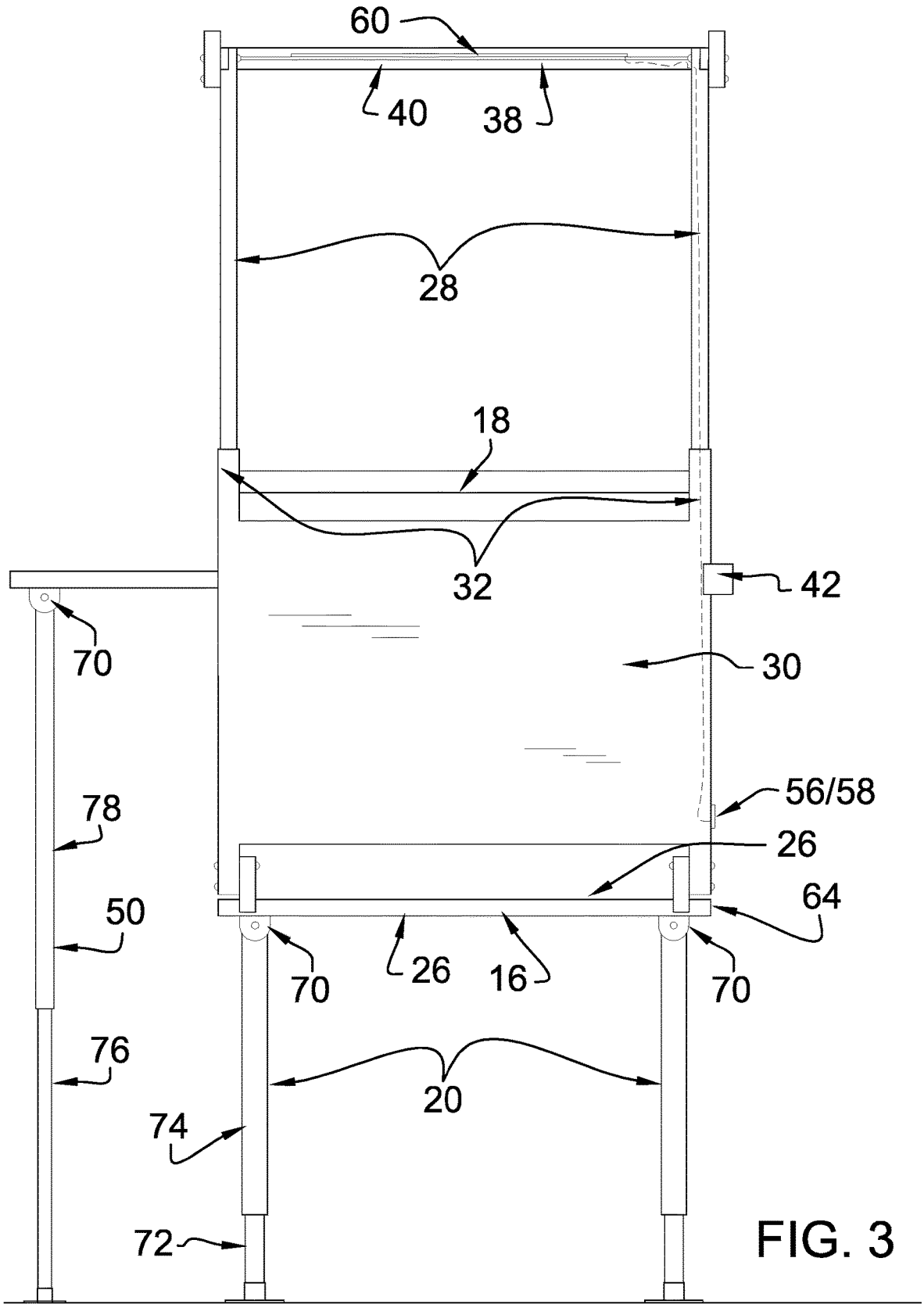
FIG. 3 is a rear view of an embodiment of the disclosure.

The first legs 20 are hingedly engaged to the first frame 16 so that the first legs 20 are selectively foldable relative to the first frame 16, as shown in FIG. 2. The second legs 50 are hingedly engaged to the plate 48 so that the second legs 50 are selectively foldable relative to the plate 48, as shown in FIG. 2. The second frame 18 is hingedly engaged to the first frame 16 so that the second frame 18 is foldable relative to the first frame 16, as shown in FIG. 4. The side arm 36 is hingedly engaged to the respective post 28 so that the side arm 36 is foldable relative to the respective post, as shown in FIG. 4. The plate 48 comprises a pair of sections 68, which are mutually hingedly engaged so that the plate 48 is selectively foldable. The hinged connections referred to in this paragraph are enabled by means of various types of adjustable locking hinges 70.

Each first leg 20 comprises a lower section 72, which is selectively extensible from an upper section 74 so that the first leg 20 is selectively length adjustable, as shown in FIG. 2. Each second leg 50 comprises a lower segment 76, which is selectively extensible from an upper segment 78 so that the second leg 50 is selectively length adjustable, as shown in FIG. 4. The side arm 36 comprises a first section 80, which is engaged to the post 28, and a second section 82, which is selectively extensible from the first section 80, as shown in FIG. 4.

A variety of extension techniques are available to effect the extensions referred to in the previous paragraph, as well as for the extension of the posts 28 from the opposed side elements 32. As shown in FIGS. 2 and 4, theses extensions are enabled by having a plurality of orifices 84 positioned in each of the upper sections 74, the upper segments 78, the first sections 80, and the opposed side elements 32. Spring loaded pins 86 positioned singly in each of the lower sections 72, the lower segments 76, the second sections 82, and posts 28 selectively engage respective orifices 84 to achieve desired extension of the first legs 20, the second legs 50, the side arms 36, and the posts 28.

Each of a plurality of first feet 88 is engaged to and extends radially from a respective first leg 20 distal from the first frame 16. The first feet 88 are configured to stabilize the chair 12 upon a surface. Each of a plurality of second feet 90 is engaged to and extends radially from a respective second leg 50 distal from the plate 48. The second feet 90 are configured to stabilize the desk 14 upon the surface.

Each of a pair of pads 92 is selectively engageable to a respective one of the first panel 22 and the second panel 24, as shown in FIG. 4. The pads 92 are configured to cushion the first panel 22 and the second panel 24. A pair of first connectors 94 is engaged singly to the first panel 22 and the second panel 24. A pair of second connectors 96 is engaged singly to the pads 92. The second connectors 96 are complementary to the first connectors 94 so that each second connector 96 is positioned to selectively engage a respective first connector 94 to removably engage the pads 92 to the first panel 22 and the second panel 24. The second connector 96 and the respective first connector 94 may comprise a zipper 98, or other connecting means, such as, but not limited to, hook and loop fasteners, ties, and the like.

Figure 5:
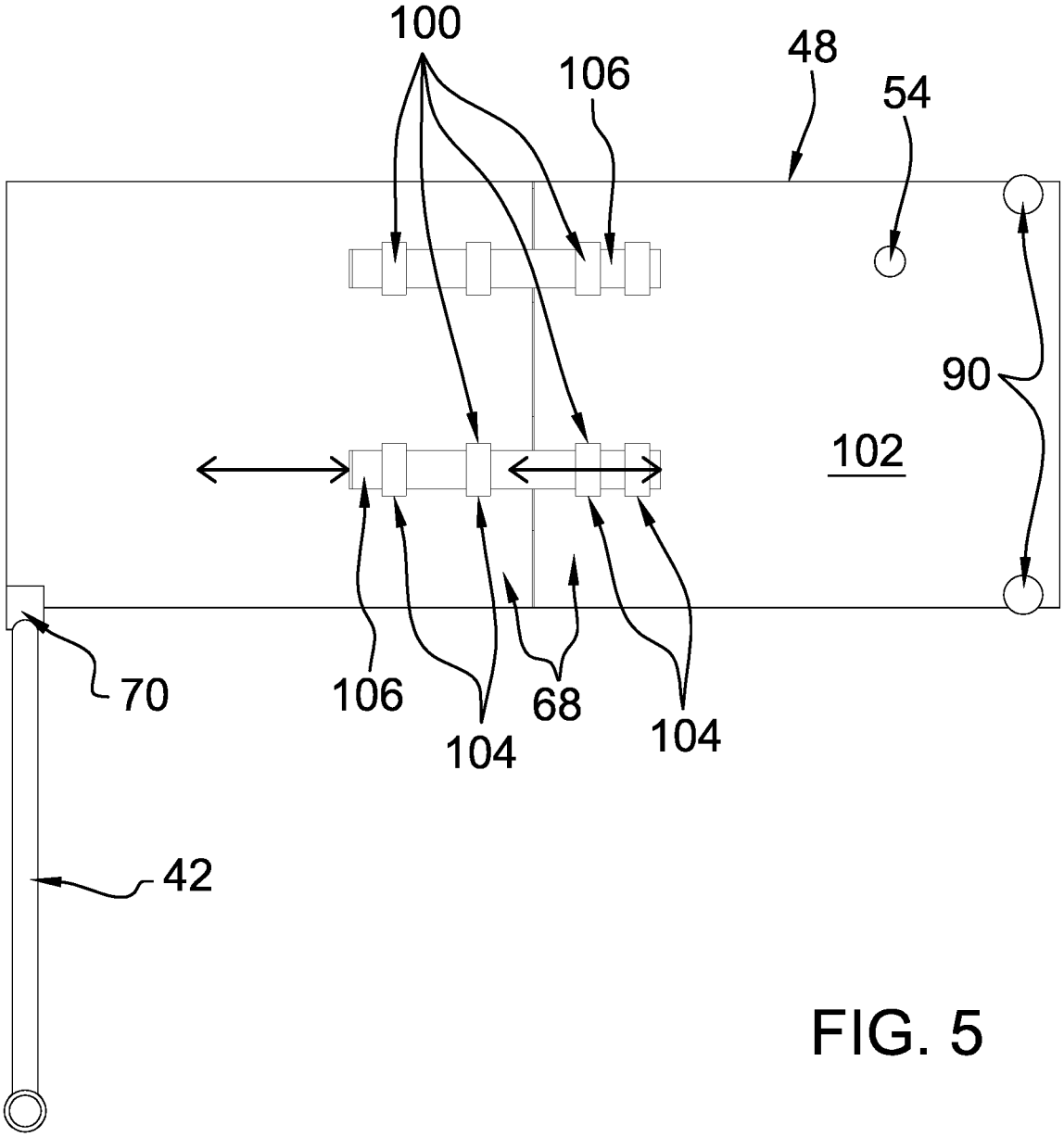
FIG. 5 is a bottom view of an embodiment of the disclosure.

A plurality of brackets 100 is engaged to an underside 102 of the plate 48, as shown in FIG. 5. The brackets 100 are positioned in pairs 104 on each section 68 of the plate 48, with the pairs 104 of brackets 100 being aligned. A bar 106, which is selectively insertable through the pairs 104 of brackets 100, is positioned to stabilize the pair of sections 68 in a planar configuration.

In one example of use, the deployable chair and desk assembly 10 is positioned in a desired location, such as a backyard, on a porch or deck, or the like. The adjustable locking hinges 70 are hinged to achieve a desired configuration and then are locked in place. The first legs 20 and second legs 50 are extended to achieve a desired height and to stabilize the deployable chair and desk assembly 10 on uneven surfaces. The pads 92 can be engaged singly to the first panel 22 and the second panel 24 to provide cushioning. The user can connect one or more electronic devices to the ports 56 so that they are powered by the solar panel 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A deployable chair and desk assembly comprising:

a chair;

a pair of posts engaged to a back of the chair and extending upwardly from the back;

a canopy engaged to and extending from the posts distal from the back of the chair, wherein the canopy is configured for shading the chair;

a beam engaged to the back of the chair and extending from the back to proximate to a front edge of the chair;

a desk engaged to the beam distal from the back of the chair, such that the desk provides a work surface for a user seated in the chair;

a set of ports, each port being engaged to one of the chair and the desk and being configured for operationally engaging an electronic device;

a solar panel engaged to an upper surface of the canopy and being operationally engaged to the set of ports, wherein the solar panel is configured for converting light into an electrical current for powering an electronic device operationally engaged to a respective port;

wherein the chair comprises:

a first frame, a first panel engaged to the first frame, a plurality of first legs engaged to and extending from the first frame, a second frame engaged to and extending from a rearward edge of the first frame, such that the second frame is opposingly positioned relative to the plurality of first legs, each post being selectively extensible from an associated one of opposed side elements of the second frame; and a second panel engaged to the second frame, wherein the second panel is configured for supporting a back of a user seated upon the first panel;

wherein the canopy comprises:

a pair of side arms, each side arm being engaged to and extending from a respective post, a crosspiece engaged to and extending between the side arms distal from the posts, and a canvas engaged to and extending between the side arms; and wherein the desk comprises:

a plate defining the work surface, a first end of the plate being engaged to the beam, and a plurality of second legs engaged to and extending from the plate.

2. The deployable chair and desk assembly of claim 1, wherein the beam is selectively engageable to the back of the chair, such that the desk is selectively separable from the chair.

3. The deployable chair and desk assembly of claim 1, wherein:

the first frame is substantially rectangularly shaped;

the plurality of first legs comprises four first legs positioned singly proximate to each corner of the first frame; and the plurality of second legs comprises two second legs extending from a second end of the plate.

4. The deployable chair and desk assembly of claim 1, wherein:

the beam is hingedly engaged to the desk, such that the beam is foldable relative to the desk;

the first legs are hingedly engaged to the first frame, such that the first legs are selectively foldable relative to the first frame;

the second legs are hingedly engaged to the plate, such that the second legs are selectively foldable relative to the plate;

the second frame is hingedly engaged to the first frame, such that the second frame is foldable relative to the first frame; and the side arm is hingedly engaged to the respective post, such that the side arm is foldable relative to the respective post.

5. The deployable chair and desk assembly of claim 1, wherein:

each first leg comprises a lower section selectively extensible from an upper section, such that the first leg is selectively length adjustable;

each second leg comprises a lower segment selectively extensible from an upper segment, such that the second leg is selectively length adjustable; and the side arm comprises a first section and a second section, the first section being engaged to the post, the second section being selectively extensible from the first section.

6. The deployable chair and desk assembly of claim 1, further including:

a plurality of first feet, each first foot being engage to and extending radially from a respective first leg distal from the first frame, wherein the first feet are configured for stabilizing the chair upon a surface; and a plurality of second feet, each second foot being engage to and extending radially from a respective second leg distal from the plate, wherein the second feet are configured for stabilizing the desk upon the surface.

7. The deployable chair and desk assembly of claim 1, further including a pair of pads, each pad being selectively engageable to a respective one of the first panel and the second panel, wherein the pads are configured for cushioning the first panel and the second panel.

8. The deployable chair and desk assembly of claim 7, further including:

a pair of first connectors engaged singly to the first panel and the second panel; and a pair of second connectors engaged singly to the pads, the second connectors being complementary to the first connectors, such that each second connector is positioned for selectively engaging a respective first connector for removably engaging the pads to the first panel and the second panel.

9. The deployable chair and desk assembly of claim 8, wherein the second connector and the respective first connector comprise a zipper.

10. The deployable chair and desk assembly of claim 1, wherein the plate comprises a pair of sections, the sections being mutually hingedly engaged such that the plate is selectively foldable.

11. The deployable chair and desk assembly of claim 10, further including:

a plurality of brackets engaged to an underside of the plate, the brackets being positioned in pairs on each section of the plate, the pairs of brackets being aligned; and a bar selectively insertable through the pairs of brackets, such that the bar is positioned for stabilizing the pair of sections in a planar configuration.

12. The deployable chair and desk assembly of claim 1, further including a hole positioned in the plate, wherein the hole is configured for selective insertion of a pole of an umbrella for engaging the umbrella to the desk.

13. The deployable chair and desk assembly of claim 1, wherein the set of ports comprises Universal Serial Bus ports.

14. A deployable chair and desk assembly comprising:

a chair, the chair comprising:

a first frame, the first frame being substantially rectangularly shaped, a first panel engaged to the first frame, a plurality of first legs engaged to and extending from the first frame, the first legs being hingedly engaged to the first frame, such that the first legs are selectively foldable relative to the first frame, each first leg comprising a lower section selectively extensible from an upper section, such that the first leg is selectively length adjustable, the plurality of first legs comprising four first legs positioned singly proximate to each corner of the first frame, a plurality of first feet, each first foot being engage to and extending radially from a respective first leg distal from the first frame, wherein the first feet are configured for stabilizing the chair upon a surface, a second frame engaged to and extending from a rearward edge of the first frame, such that the second frame is opposingly positioned relative to the plurality of first legs, the second frame being hingedly engaged to the first frame, such that the second frame is foldable relative to the first frame, a second panel engaged to the second frame, wherein the second panel is configured for supporting a back of a user seated upon the first panel, a pair of pads, each pad being selectively engageable to a respective one of the first panel and the second panel, wherein the pads are configured for cushioning the first panel and the second panel, a pair of first connectors engaged singly to the first panel and the second panel, and a pair of second connectors engaged singly to the pads, the second connectors being complementary to the first connectors, such that each second connector is positioned for selectively engaging a respective first connector for removably engaging the pads to the first panel and the second panel, the second connector and the respective first connector comprising a zipper;

a pair of posts engaged to a back of the chair and extending upwardly from the back, each post being selectively extensible from an associated one of opposed side elements of the second frame;

a canopy engaged to and extending from the posts distal from the back of the chair, wherein the canopy is configured for shading the chair, the canopy comprising:

a pair of side arms, each side arm being engaged to and extending from a respective post, the side arm being hingedly engaged to the respective post, such that the side arm is foldable relative to the respective post, the side arm comprising a first section and a second section, the first section being engaged to the post, the second section being selectively extensible from the first section, a crosspiece engaged to and extending between the side arms distal from the posts, and a canvas engaged to and extending between the side arms;

a beam engaged to the back of the chair and extending from the back to proximate to a front edge of the chair;

a desk engaged to the beam distal from the back of the chair, such that the desk provides a work surface for a user seated in the chair, the beam being selectively engageable to the back of the chair, such that the desk is selectively separable from the chair, the beam being hingedly engaged to the desk, such that the beam is foldable relative to the desk, the desk comprising:

a plate defining the work surface, a first end of the plate being engaged to the beam, the plate comprising a pair of sections, the sections being mutually hingedly engaged such that the plate is selectively foldable, a plurality of brackets engaged to an underside of the plate, the brackets being positioned in pairs on each section of the plate, the pairs of brackets being aligned, a bar selectively insertable through the pairs of brackets, such that the bar is positioned for stabilizing the pair of sections in a planar configuration, a hole positioned in the plate, wherein the hole is configured for selective insertion of a pole of an umbrella for engaging the umbrella to the desk, a plurality of second legs engaged to and extending from the plate, the second legs being hingedly engaged to the plate, such that the second legs are selectively foldable relative to the plate, each second leg comprising a lower segment selectively extensible from an upper segment, such that the second leg is selectively length adjustable, the plurality of second legs comprising two second legs extending from a second end of the plate, and a plurality of second feet, each second foot being engage to and extending radially from a respective second leg distal from the plate, wherein the second feet are configured for stabilizing the desk upon the surface;

a set of ports, each port being engaged to one of the chair and the desk and being configured for operationally engaging an electronic device, the set of ports comprising Universal Serial Bus ports; and a solar panel engaged to an upper surface of the canopy and being operationally engaged to the set of ports, wherein the solar panel is configured for converting light into an electrical current for powering an electronic device operationally engaged to a respective port.

* * * * *